US007766204B2

(12) United States Patent
Spasov et al.

(10) Patent No.: US 7,766,204 B2
(45) Date of Patent: Aug. 3, 2010

(54) HAND-HELD DRIVE-IN TOOL

(75) Inventors: Robert Spasov, Schaan (LI); Matthias Blessing, Frastanz (AT); Hans Gschwend, Buchs (CH); Ulrich Schiestl, Feldkirch (AT)

(73) Assignee: Hilti Aktiengesellschaft, Schaan (LI)

( * ) Notice: Subject to any disclaimer, the term of this patent is extended or adjusted under 35 U.S.C. 154(b) by 43 days.

(21) Appl. No.: 11/986,412

(22) Filed: Nov. 20, 2007

(65) Prior Publication Data

US 2008/0121678 A1 May 29, 2008

(30) Foreign Application Priority Data

Nov. 27, 2006 (DE) ..... 10 2006 035 459

(51) Int. Cl.
*B27F 7/17* (2006.01)
*B25C 1/04* (2006.01)

(52) U.S. Cl. ..... 227/8; 227/120; 227/136; 227/138

(58) Field of Classification Search ..... 227/8, 227/120, 136, 138, 10, 119
See application file for complete search history.

(56) References Cited

U.S. PATENT DOCUMENTS 3,615,049 A * 10/1971 Obergfell et al. ..... 227/28
3,905,535 A * 9/1975 Novak et al. ..... 227/120
3,920,169 A * 11/1975 DeCaro ..... 227/136
4,051,990 A * 10/1977 Chromy et al. ..... 227/10
4,930,673 A * 6/1990 Pfister ..... 227/10
4,932,580 A * 6/1990 Pfister et al. ..... 227/10
6,267,284 B1 * 7/2001 Clark ..... 227/8
6,708,860 B1 3/2004 Thieleke
6,783,043 B2 * 8/2004 Jakob et al. ..... 227/8
6,913,179 B1 * 7/2005 Chen ..... 227/8
6,966,477 B1 * 11/2005 Chien-Kuo et al. ..... 227/8
6,994,240 B2 * 2/2006 Jakob et al. ..... 227/8
7,059,507 B2 * 6/2006 Almeras et al. ..... 227/8
7,150,385 B1 * 12/2006 Wen ..... 227/8

FOREIGN PATENT DOCUMENTS

DE 4013022 1/1990

* cited by examiner

*Primary Examiner*—Scott A. Smith
(74) *Attorney, Agent, or Firm*—Abelman, Frayne & Schwab

(57) ABSTRACT

A hand-held drive-in tool driving fastening elements (60), e.g., nails in a workpiece (U) includes a magazine (61) projecting sidewise from the muzzle part (15) and having a spring-biased transporting slide (63) for displacing the fastening elements (60) in the magazine guide channel (62), a safety device (25) including a press-on member (14) secured on the tool muzzle part (15) of the tool, and a device (40) actuatable by the press-on member (14) for positioning of the transporting slide (63) and for displacing the transporting slide (63) against a biasing force of the transporting spring.

9 Claims, 5 Drawing Sheets

HAND-HELD DRIVE-IN TOOL

BACKGROUND OF THE INVENTION

1. Field of the Invention

The present invention relates to a hand-held drive-in tool for driving fastening elements in a workpiece that includes a guide, a drive-in ram for driving-in the fastening elements, a muzzle part having a drive-in channel defining a receiving space for a fastening element, a magazine projecting sidewise from the muzzle part and having a guide channel for the fastening elements, a transporting slide for displacing the fastening elements in the guide channel, and a transporting spring for biasing the transporting slide in a transporting direction for feeding a fastening element into the receiving space, the tool further including a safety device having a press-on member supported on the muzzle part.

2. Description of the Prior Art

Drive-in tool of the type described above can be driven with, e.g., solid, gaseous, or liquid fuels, with compressed air, or electrically. As an energy accumulator for the drive-in ram in electrically driven tools, e.g., a mechanical drive spring, which is preloaded by an electrically driven tensioning mechanism, is used.

German Publication DE 40 13 022 A1 describes a drive-in tool of the type described above. The drive-in tool includes an impact mechanism for driving in a fastening element, e.g., a nail and which is preloaded toward a muzzle by a drive spring. A positioning device for displacing the impact mechanism in a drive-in position includes an electric motor and a speed reducing mechanism. A rotational movement of the electric motor is transmitted by the speed reduction mechanism and a cooperating therewith tooth disc to a hammer body with a drive-in ram of the impact mechanism, in order to displace the hammer body against a biasing force of a drive spring from an initial position to a drive-in-ready position in which the impact mechanism is ready for effecting an impact process.

The displacement in the drive-in-ready position is effected only upon actuation of the actuation switch. A magazine for fastening elements projects at a right angle from a muzzle part. In the magazine, there is arranged a spring-biased slide with which fastening elements such as, e.g., nails are displaced in the direction of a guide for the drive-in ram of the hammer body. The drive-in tool further includes an adjusting member that has a press-on element which projects axially beyond the muzzle of the muzzle part in the initial position of the drive-in tool when the tool is not pressed against a workpiece. The adjusting element functions as a safety element that insures that the drive-in tool cannot be actuated when the drive-in tool is not pressed with its muzzle against a workpiece.

In the known drive-in tool, the feeding of a fastening element in the receptacle in the guide for the drive-in ram in the muzzle part is effected only then when the drive spring is preloaded after actuation of the actuation switch, and the drive-in ram is displaced away in the guide in the nuzzle part. The fastening element, which was brought in the receptacle of the guide by the transporting slide, lies in front, in the drive-in direction, of the drive-in ram and will be ejected from the guide by the drive-in ram which is accelerated toward the muzzle by the drive spring. With the drive-in tool having a high setting energy such as, e.g., drive-in tools with strong drive springs, it makes sense, because of the relatively long time necessary for preloading the drive spring, to initiate a setting process already upon pressing of the drive-in tool against the workpiece. However, the drawback of the known drive-in tool consists in that the drive spring must remain preloaded in case of interruption of the drive-in process because the drive-in ram cannot be displaced again in its initial position, without first ejecting of the fastening element.

The object of the present invention is to provide a drive-in tool of the type described above in which the drawback of the known tool is eliminated and a release of the drive spring of the drive-in ram is possible, without driving a fastening element out when the drive-in tool is not actuated and is lifted again off a constructional element or workpiece.

SUMMARY OF THE INVENTION

This and other objects of the present invention which will become apparent hereinafter, are achieved by providing in a drive-in tool of the type described above, a device actuatable by the press-on member for positioning the transporting slide and for displacing the transporting slide against a biasing force of the transporting spring.

The positioning device permits to remove, from the receiving space of a drive-in channel, a fastening element n case it still remains there, at each lifting of the drive-in tool off a workpiece. This makes possible, e.g., a time-controlled release of the drive spring member and displacement of the drive-in ram in the drive-in channel, without the fastening element being discharged or ejected therefrom.

According to a modified embodiment of the invention, the press-on member is formed as a press-on filler displaceable relative to the muzzle part along an axis defined by the drive-in channel between its initial position and its press-on position. The press-on feeler projects, in its initial position, axially beyond the muzzle of the muzzle part and, in the press-on position, is maximally displaced toward the tool housing or is displaced into the housing, as the case may be.

Advantageously, the positioning device includes a counter-slide mechanically connected with the press-on member and displaceable, dependent on operation of the press-on member, between a neutral position and a biasing position for displacing the transporting slide, respectively, between a position in which the transporting slide is able to advance a fastening element in the receiving space of the drive-in channel, and a position in which the transporting slide is movable against a biasing force of the transporting spring. The displacement of the press-on member along an axis defined by the drive-in channel is directly and in a simple manner is converted in a translational movement of the counter-slide along an axis defined by the guide channel of the magazine for fastening elements. This permits to provide a lightweight transporting slide that can be cost-effectively produced and mounted.

It is advantageous when the counter-slide is fork-shaped and has at least two entraining elements defining a free-space and keeping the drive-in channel free in both the neutral position and the biasing position of the counter-slide. The at least two entraining elements engage a carrier strip carrying the fastening elements. Because the drive-in channel is not blocked or narrowed by the counter-slide in any position of the counter slide, a collision with the drive-in ram is not possible at any time.

In a technically simple embodiment, a mechanical connection of the press-on member with the counter-slide is effected with a link drive arranged therebetween.

According to a further advantageous embodiment of the invention, the press-on member includes an electrical press-on switch that can be formed integrally with the press-on member as a single component. With the provision of the electrical press-on switch, the positioning device can be electrically controlled, so that a mechanical connection can be avoided.

It is advantageous, when the positioning device has tensioning means for displacing the transporting slide against the biasing force of the transporting spring in a biasing position of the positioning device. The tensioning means can be used in addition to the counter-slide or replace the same. When only tensioning means is used, the adaptation of the geometry of the muzzle part to the counter slide becomes unnecessary, as no counter-slide is used.

In an advantageous and technically easy to produce embodiment of the drive-in tool, the tensioning means comprises at least one tensioning element such as, e.g., a rope, band, chain, wire, etc. and drive means for the tensioning element for displacing the same in the tensioning direction for displacing the transporting slide against the biasing force of the transporting spring. Advantageously, the drive means has an electric motor and take-up spool for the tensioning element and which is supported on the output shaft of the electric motor.

The novel features of the present invention which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
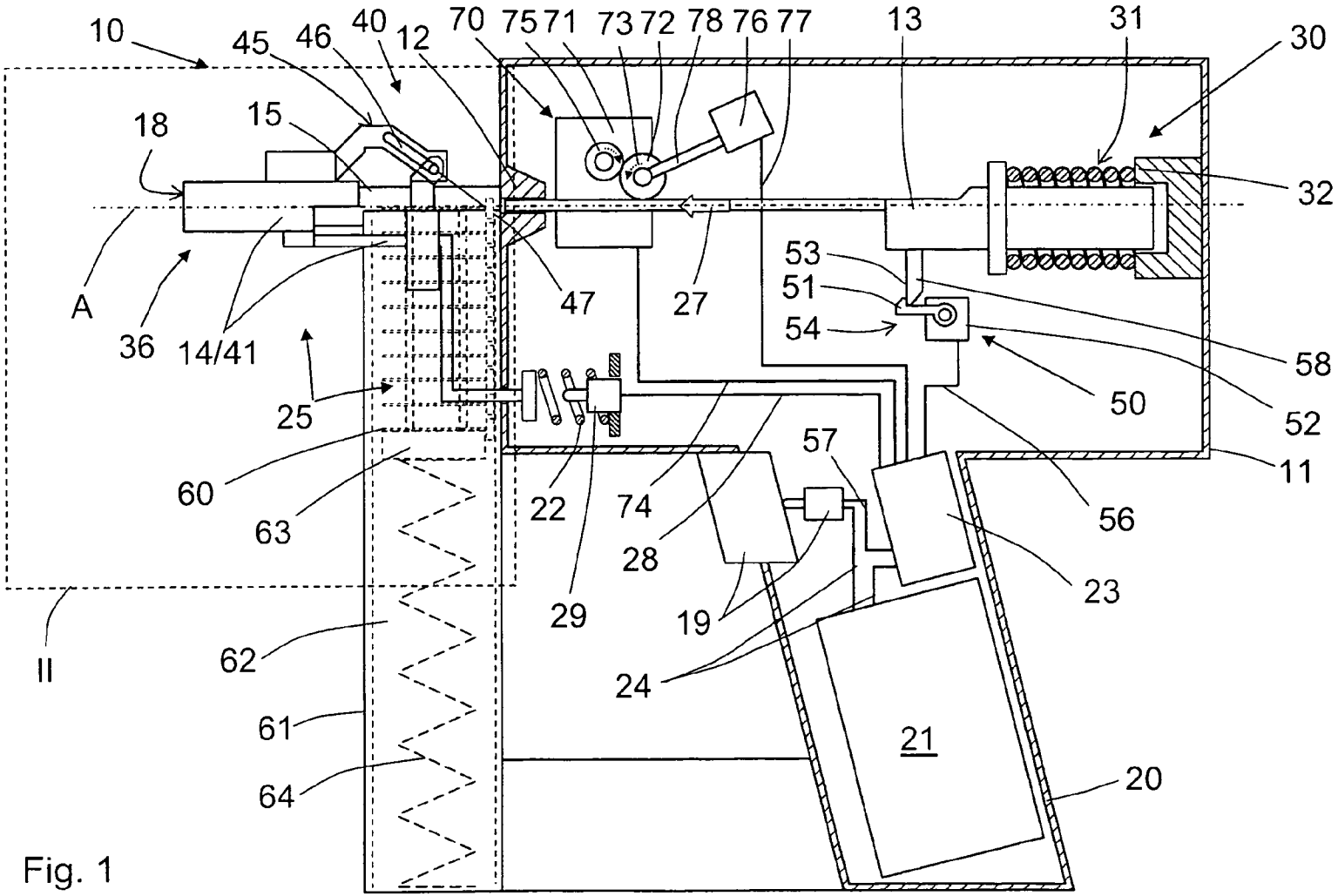
FIG. 1 a longitudinal cross-sectional view of a drive-in tool according to the present invention in an initial position thereof with a preloaded drive spring member.
Figure 2:
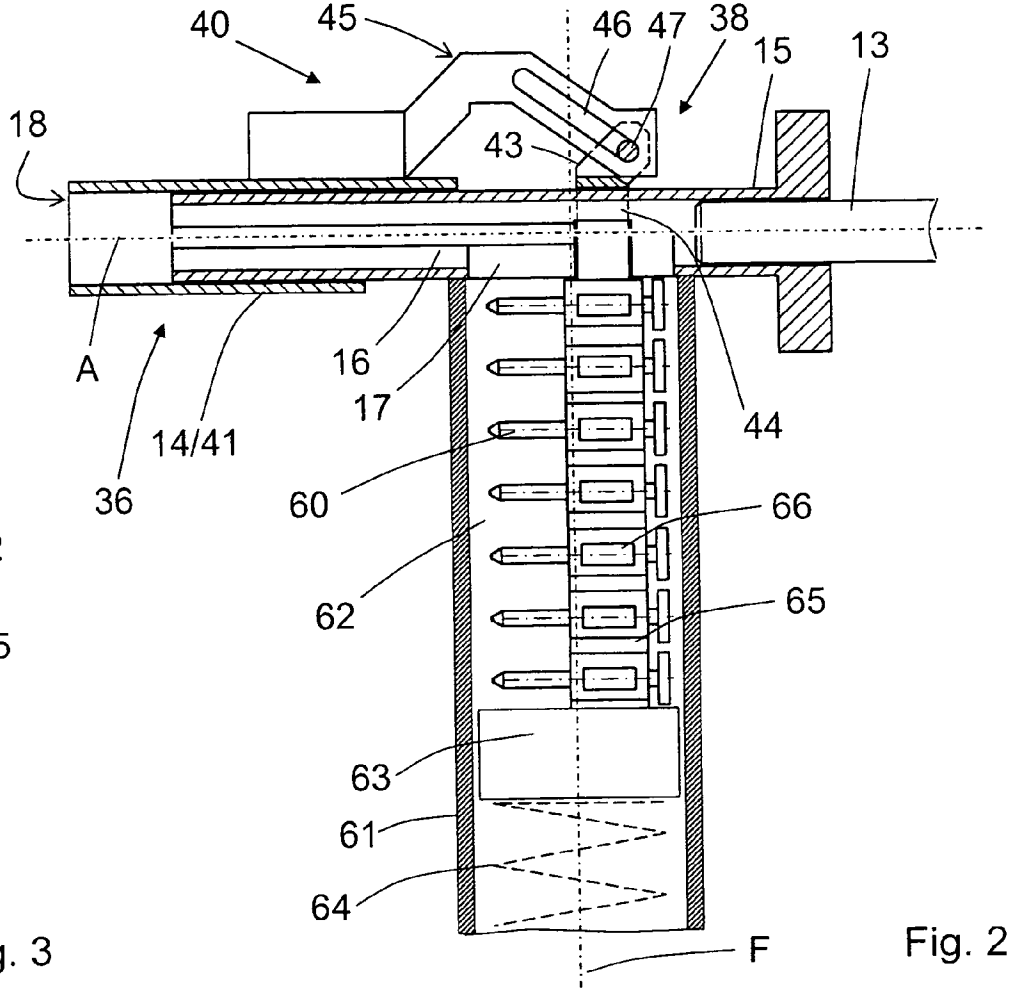
FIG. 2 a cross-sectional view of a detail of the drive-in tool designated in FIG. 1 as II.

A drive-in power tool 10 according to the present invention, which is shown in FIGS. 1 through 5, is formed, e.g., as an electrically driven drive-in tool and includes a driving spring member 31. The drive-in tool 10 further includes a housing 11, a guide 12 located in the housing 11, a drive-in ram 13 displaceable in the guide 12, and a drive unit for displacing the drive-in ram 13 and generally designated with a reference numeral 30.

A muzzle part 15, which extends coaxially with the drive-in ram guide 12, adjoins the guide 12 at an end of the guide 12 facing in the drive-in direction 27. The muzzle part 15 has a drive-in channel 16 which defines a receiving space 17 for fastening elements 60. Sidewise of the muzzle part 15, there is arranged a magazine 61 for the fastening elements 60. The magazine 61 has a guide channel 62 which extends along a guide axis F and in which a carrier strip 65 that carries the fastening elements 60, is stored. The guide channel 62 opens into the receiving space 17. The carrier strip 65, together with the fastening elements 60, is biased in the direction of the receiving space 17 by a transporting slide 63 which is, in turn, biased by a transporting spring 64 likewise in the direction of the receiving space 17 (see, in particular FIGS. 2 through 5). On the carrier strip 65, on its both sides, there are provided projections 66 which project sidewise toward a plane defined by fastening elements 60.

The driving spring member 31 forms part of the drive unit 30 and has one of its ends indirectly supported against the housing 11 via a support element 32, with the other, opposite end of the driving spring member 31 engaging the drive-in ram 13.

In FIG. 1, the drive-in tool 10 is not pressed any more against a workpiece U. However, in FIG. 1, the drive-in ram 13 is still in a drive-in-ready position in which it is elastically preloaded against the drive spring member 31. The drive-in ram 13 is displaced into the drive-in-ready position 31 by the drive-in tool 10 being pressed against the workpiece U (see FIGS. 4 and 5), whereby a preloading device 70, which will be described in detail further below, is released.

The drive-in ram 13 is held in the drive-in-ready position by a locking device generally designated with a reference numeral 50. The locking device 50 has a pawl 51 that engages, in a locking position 54 (see FIG. 1), a locking surface 53 of a projection 58 of the drive-in ram 13, retaining the drive-in ram 13 against the biasing force of the drive-in spring member 31. The pawl 51 is supported on a servo motor 52 that displaces the pawl 51 in a release position (not shown in the drawings). A first control conductor 56 connects the servo motor 52 with the control unit 23.

The drive-in tool 10 further includes a handle 20 on which an actuation switch 19 is arranged. The actuation switch 19 initiates a drive-in process with the drive-in power tool 10. In the handle 20, a power source 21, which supplies the drive-in tool with electrical energy, is located. Generally, the power source 21 has at least one accumulator. The power source 21 is connected by electrical feeding conductors 24 both with the control unit 23 and the actuation switch 19. A switching conductor 57 connects the control unit 23 with the actuation switch 19.

Figure 4:
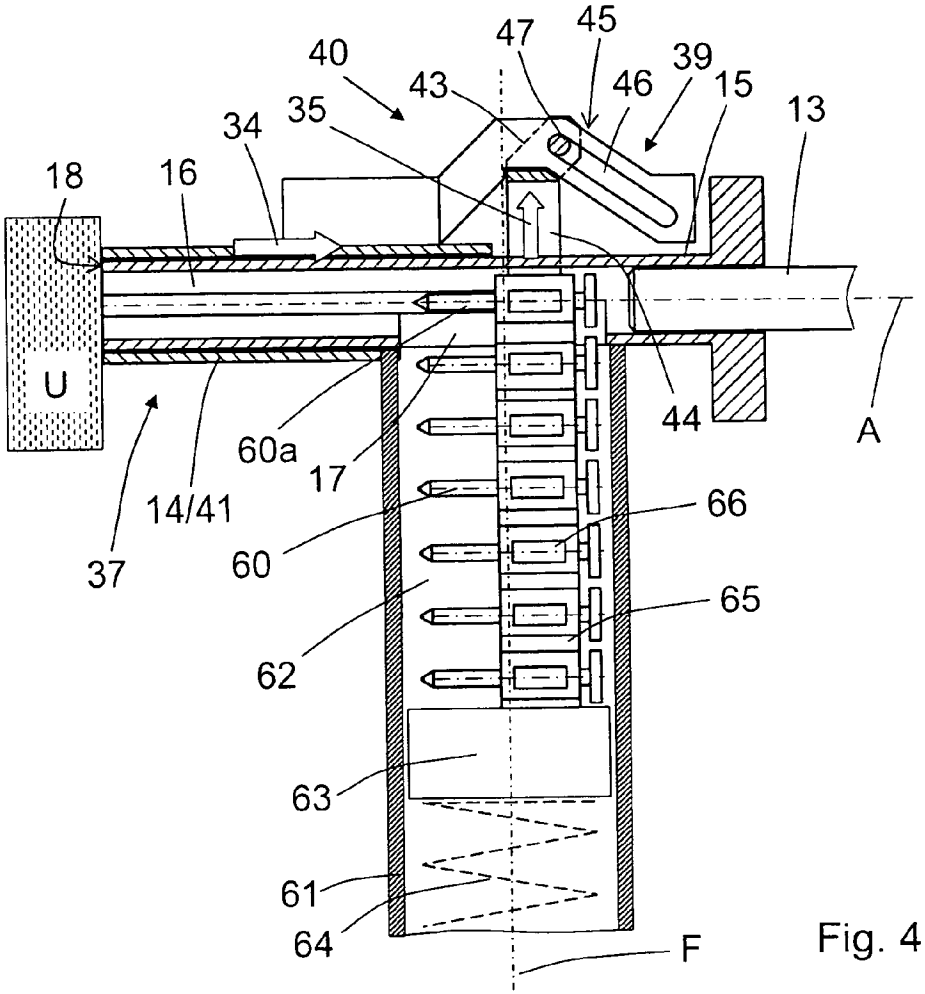
FIG. 4 a cross-sectional view of the detail II shown in FIG. 2 in a condition of the drive-in tool pressed against a workpiece.

The muzzle part 15 of the drive-in tool 15 is provided with a press-on member 14, which is formed as a press-on feeler 41 and forms part of a safety device 25. The press-on member 14 actuates a press-on switch 29 of the safety device 25 and which is connected with the control unit 23 by an electrical switching conductor 28. The press-on switch 29 sends an electrical signal to the control unit 23 as soon as the drive-in tool 10 is pressed, with the muzzle 18 of the muzzle part 15, against the workpiece U, as shown in FIG. 4. Thus, the press-on switch 29 insures that the drive-in tool 10 can only then be actuated when it is properly pressed against the workpiece U. The press-on member 14 is displaceable along axis A. which is defined by the drive-in channel 16, between an initial position 36 (FIGS. 1 and 2) and a press-on position 37 (FIG. 4).

As it has already noted above, the drive-in tool 10, includes a preloading device 70. The preloading device 70 has an electrically driven motor 71 that drives a driving roller 72. The motor 71 is connected by a second control conductor 74 with the control unit 23. The control unit 23 actuates the motor 71, e.g., when the control unit 23 is actuated in response to actuation of the press-on switch 29 by the press-on member 14, or after completion of a drive-in process when the drive-in tool 10 is lifted off the workpiece U. The motor 71 has a driving gear 75 connectable with the driving roller 72.

The driving roller 72 is rotatably supported on a longitudinally adjustable arm 78 of servo means 76 formed as a solenoid. The servo means 76 is connected by an actuation conductor 77 with the control unit 23. The adjustment of the arm 78 is effected by the servo means 76 simultaneously with the start of the motor 71. During the operation, the driving roller 72 rotates in a direction shown with a dash arrow 73 for displacing the drive-in ram 13 against the drive spring member 31 for tensioning the same. When the drive-in ram 13 reaches its drive-in-ready position (FIG. 1), the pawl 51 of the locking device 50 engages the locking surface 53 on the drive-in ram 13, retaining the drive-in ram 13 in its drive-in ready position 22. Then, the motor 71 can be turned off by the control unit 23, and the servo means 76, which is also controlled by the control unit 23, displaces the driving roller 72 from its position in which it engages the driven means 75 and, accordingly, the drive-in ram 13, into a decoupled or disengaged position (not shown in the drawings).

When the drive-in tool 10 is pressed against the workpiece U, the press-on member 14 and the press-on switch 29 set the control unit 23 in a setting process-ready condition, and when a user actuates the actuation switch 19, the control unit 23 places the locking device 50 in its release position in which the servo motor 52 lifts the pawl 51 of the locking surface 53 on the drive-in ram 13.

As a result of the pawl 51 being lifted off the locking surface 53, the drive-in ram 13 is displaced by the drive spring member 31 in the drive-in direction 27, driving a fastening element 60 in the workpiece U (not shown in the Figures).

For displacing the drive-in ram 13 in its drive-in-ready position and for tensioning the drive spring member 31, at the end of the drive-in process, when the drive-in tool is lifted off the workpiece U, or later when the drive-in tool 10 is again pressed against the workpiece U, the preloading device 70 is again actuated by the control unit 23. To this end, the press-on switch 29 generates a signal that is communicated to the control unit 23. The control unit 23 again actuates the preloading device 70 that displaces the drive-in ram 13, in a manner already described above, against the biasing force of the drive spring member 31, again tensioning the drive-in spring member 31, until the pawl 51 can again engage the locking surface 53 on the drive-in ram 13 in the locking position 54 of the locking device 50.

The drive-in tool 10 also has a positioning device, which is generally designated with a reference numeral 40, for the transporting slide 63. The positioning device 40 is controlled by the press-on member 14 of the safety device 25. The positioning device 40, which will be described in more detail further below, can displace a fastening element 17, which is located in the receiving space 17 of the drive-in channel 16, from the receiving space 17 back in the guide channel 62 by displacing the transporting slide 63 and the carrier strip 65 with the fastening elements 60 against the biasing force of the transporting spring 64 upon lifting of the drive-in tool 10 off the workpiece U.

Figure 3:
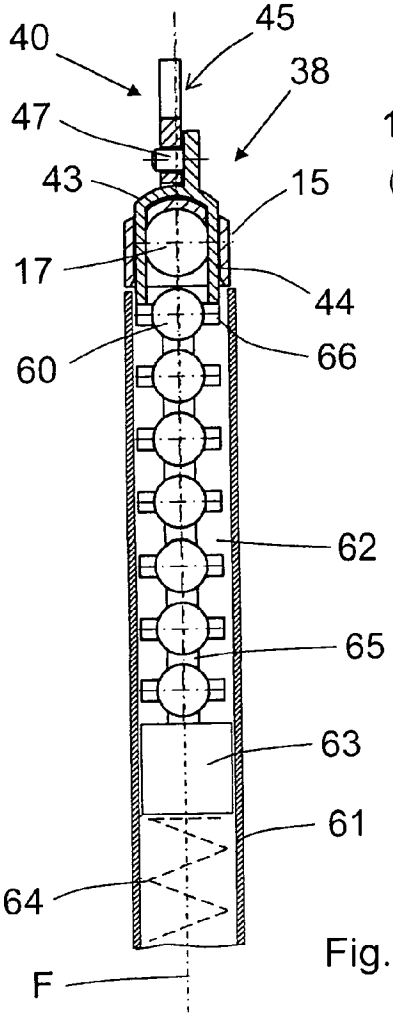
FIG. 3 a cross-sectional view along line III-III in FIG. 2.
Figure 5:
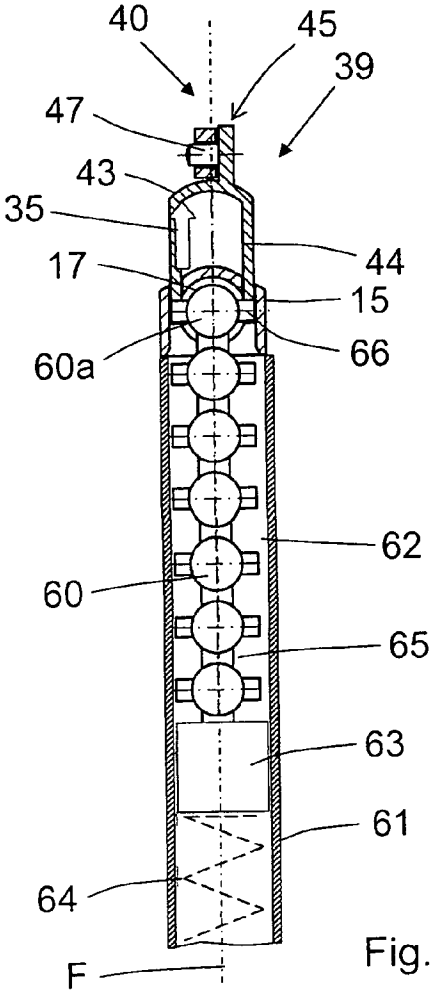
FIG. 5 a cross-sectional view along line IV-IV in FIG. 4.

The positioning device 40, which is shown in FIGS. 1-5, has a counter-slide 43 of the transporting slide 63 and which is mechanically connected with the press-on member 14 by a link drive 45, whereby displacement of the press-on member 14 along the axis A is converted into displacement of the counter-slide 43 along the guide axis F defined by the guide channel 62. The link drive 45 has a link 46, which is secured to the press-on member-forming press-on filler 41, and a pin 47 which is secured on the counter-slide 43 and is displaceable within the link 46. The counter-slide 43 is formed as a fork-shaped part and has, at its end remote from the link drive 45, two flat tine-shaped entraining elements 44. The counter-slide 43 is displaceable back and forth between a neutral position 39 which is shown in FIGS. 4-5 and in which the counter slide 43 is displaced maximum far away from the muzzle part 15, and a biasing position 38 which is shown in FIGS. 1 and 3 in which the counter slide 43 is located in the muzzle part 15. In its biasing position 38, the counter slide 43 engages, the projections 66, with the free ends of its entraining elements 44, which are provided on opposite sides of the carrier strip 65, pressing the carrier strip 65, together with the transporting slide 63, against the biasing force of the transporting spring 64 and into the guide channel 62, displacing the last, in the transporting direction, fastening element **60*a* out of the receiving space 17. Thus, both in the neutral position 39 and in the biasing position 38 of the counter-slide 43, the drive-in channel 16 remains free and is not narrowed or blocked by the counter-slide 43. In the biasing position 38, the positioning device 40 keeps the drive-in channel 16 free, so that the drive-in ram 13 can be displaced to its initial position, without ejecting the fastening element 60. Thus, e.g., a time-controlled release of the drive spring member 31, which is controlled by the control unit 23, is possible. The press-on feeler 41 retains, in its initial position 36, the counter-slide 43 in its biasing position, with the press-on feeler 41 being held in its initial position 36 by a spring 22 shown in FIG. 1 when the drive-in tool 10** is not pressed against the workpiece U.

When the drive-in tool 10 is pressed with its muzzle 18 against the workpiece U, as shown in FIGS. 4-5, the press-on feeler 41 is displaced in direction of the first arrow 34 along the axis A relative to the muzzle part 15 in its press-on position 37. The counter-slide 43 is displaced in direction of the second arrow 35 into its neutral position 39, and the transporting slide 63, which is biased by the transporting spring 64, is also displaced in the direction of the second arrow 35, displacing a fastening element **60*a* in the receiving space 17. Upon a subsequent lifting of the drive-in tool 10 off the workpiece U, the press-on feeler 41 is displaced by the spring 22 in the direction opposite the direction of the first arrow 34 along the axis A in its initial position 36. This displacement of the press-on feeler 41 is transmitted by the link drive 45 to the counter-slide 43 so that the counter-slide 43 is displaced in the direction opposite the direction of the second arrow 35 in its biasing position 38 shown in FIGS. 2-3, displacing the carrier strip 65, together with the transporting slide 63, against the biasing force of the transporting spring 64, and no fastening element 60 is located in the receiving space 17** any more.

Figure 6:
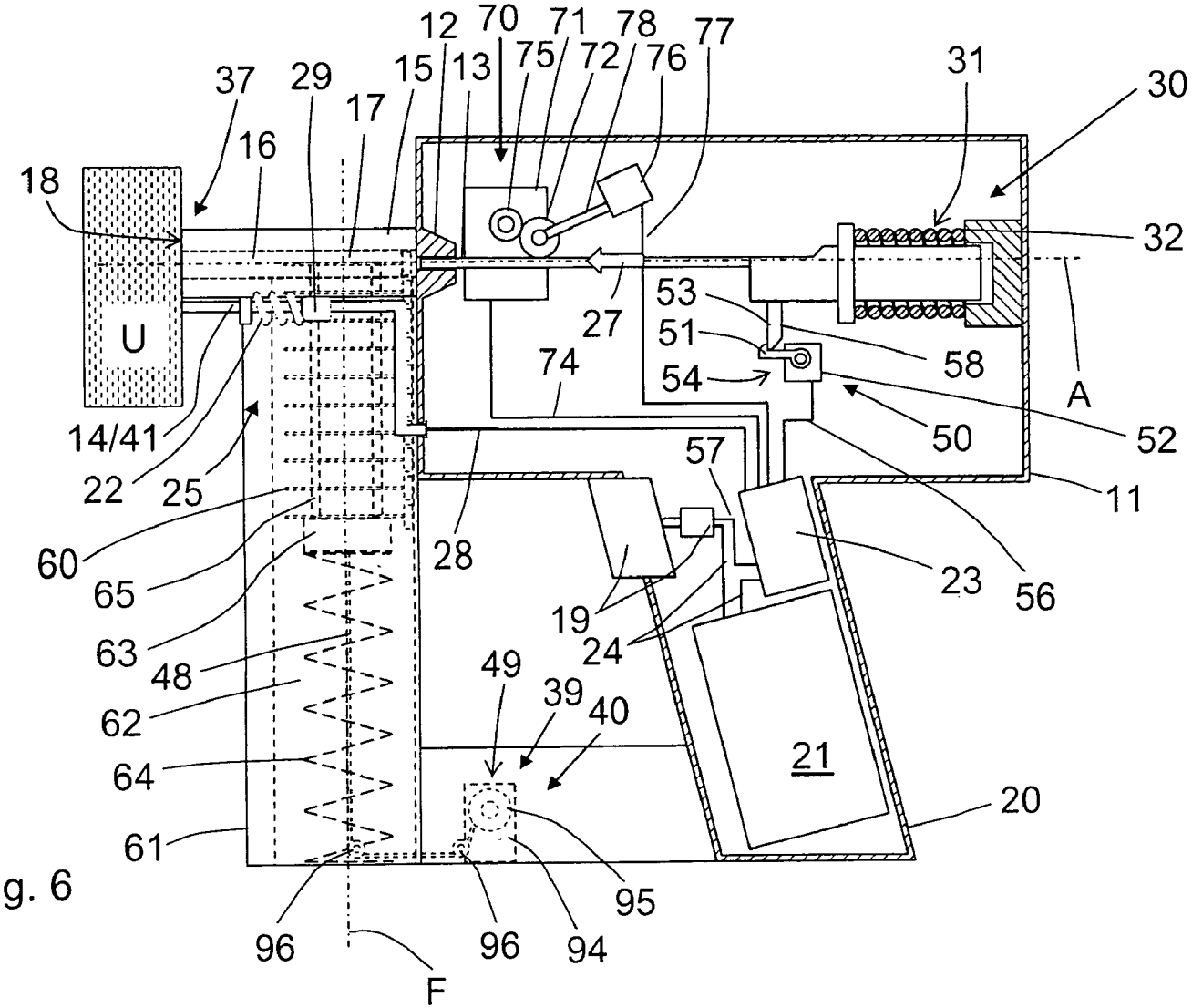
FIG. 6 a cross-sectional view of another embodiment of the drive-in tool according to the present invention in a condition in which the tool is pressed against a workpiece.
Figure 7:
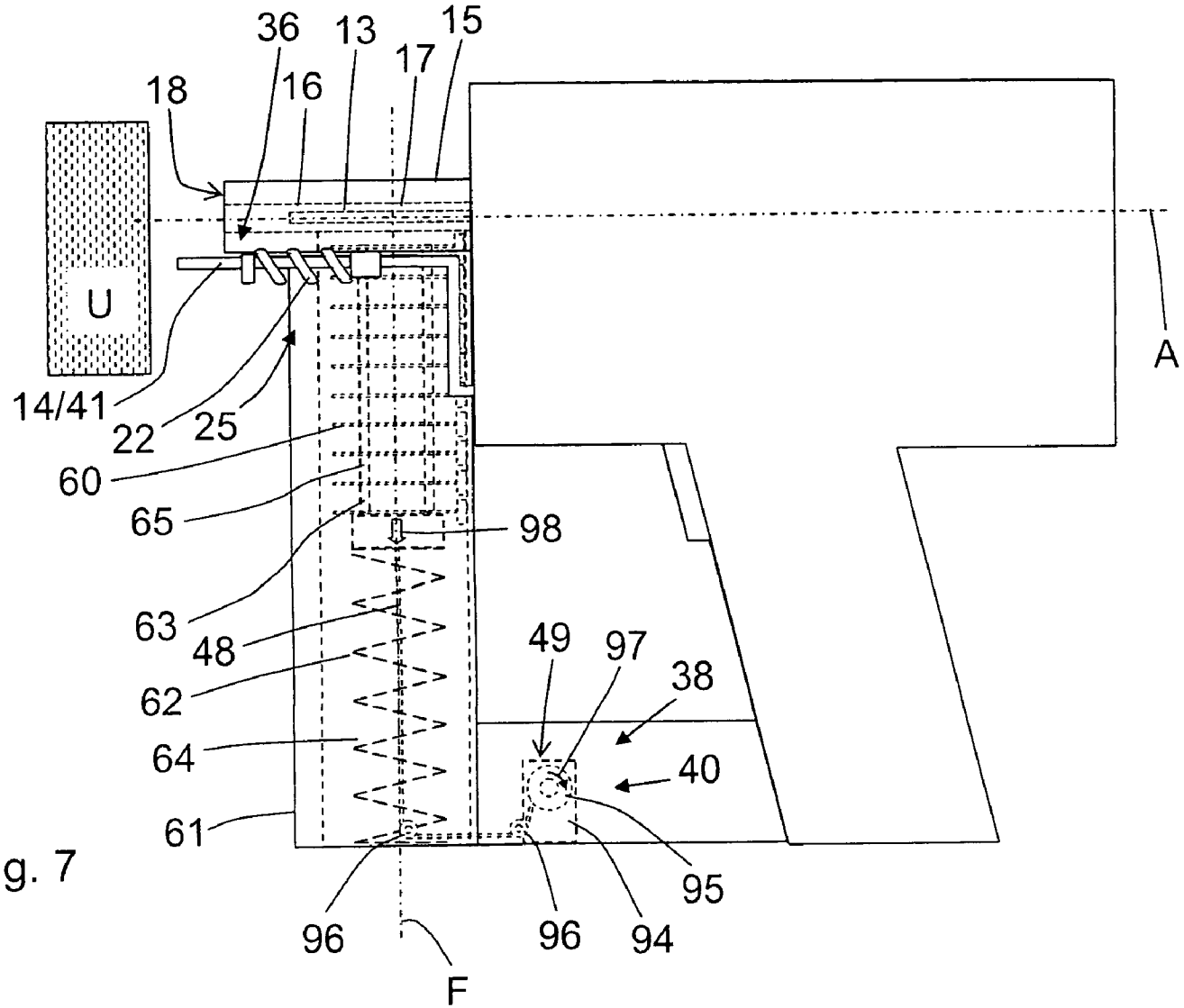
FIG. 7 a cross-sectional view of the drive-in tool shown in FIG. 6 in a condition when it is lifted off the workpiece.

FIGS. 6-7 show another embodiment of the drive-in tool 10. The drive-in tool 10 shown in FIGS. 6-7 differs from the tool shown in FIGS. 1-5 by the design of the positioning device 40. For the elements of the positioning device 40 of the drive-in tool 10 shown in FIGS. 6-7, which are not mentioned below, reference should be made to the description of similar elements of the positioning device 40 of the drive-in tool shown in FIG. 1-5. The positioning tool 40 of the drive-in device 10 shown in FIGS. 6-7, has instead of the counter-slide, a tensioning device that contain a rope- or band-shaped tensioning element 48 and drive means 49 for the tensioning element 48. The drive means 49 is formed as an electric motor 94 on the output shaft of which a take-up spool 95 for the tensioning element 48 is arranged. The end of the tensioning element 48 remote from the take-up spool 95 is connected with the transporting slide 63. For guiding the tensioning element 48 from the transporting slide 63 toward the take-up spool 95, there is provided a deflection roller 96.

The actuation of the electric motor 94 is controlled by the press-on member 14 and/or the press-on switch 29 via the control unit 23 with which the electric motor 94 is connected by a control conduit (not shown). The press-on member 14 and the press-on switch 29 can form as a unitary functional unit.

In FIG. 6, the drive-in tool 10 is pressed against the workpiece U. The press-on member 14 is in its press-on position 37 in which the press-on switch 29 is actuated by the press-on member 14. In the press-on position 37 of the press-on member 14, the positioning device 40 is in its neutral position 39. Therefore, the transporting slide 63 is able to transport a fastening element 60*a* into the receiving space 17 of the drive-in channel 16, holding it there. Accordingly, a setting process becomes possible.

In FIG. 7, the drive-in tool 10 is lifted off the workpiece U, without a drive-in process being initiated before the lifting-off. The press-on member 14, together with the press-on switch 29, are displaced in their initial position 36. The positioning device 40 is actuated by the control unit 23 and is displaced into its biasing position 38 in which the electric motor 94 rotates the take-up spool 95 in the direction of the third arrow 97. A predetermined length of the tensioning member 48 is wound onto the take-up spool 95, and the transporting slide 93 is displaced in the direction of the fourth arrow 98 against the biasing force of the transporting spring 64, displacing the carrier strip 65, together with the fastening element 60*a* which is located in the receiving chamber 17 of the drive-in channel 16, whereby the fastening element 60*a* is displaced out of the receiving chamber 17. In the biasing position 38 of the positioning device 40, the tensioning element 48 can be retained in its position by a locking device (not shown) that locks the take-up spool 95 that can be rotated only by the electric motor 94 in one of the two possible rotational directions. In the biasing position 38, the positioning device 40 keeps the drive-in channel 16 empty again, so that the drive-in ram 13 can be displaced in its initial position (see FIG. 7), without ejecting a fastening element 60*a*. With this embodiment of the invention likewise, a time-controlled release of the drive spring member 31 is possible, which can be controlled by the control unit 23.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A hand-held drive-in tool for driving fastening elements (60) in a workpiece (U), comprising:

a guide (12);

a drive-in ram (13) for driving the fastening elements (60) in the workpiece (U);

a muzzle part (15) having a drive-in channel (16) defining a receiving space (17) for a fastening element (60);

a magazine (61) projecting sidewise from the muzzle part (15) and having:

a guide channel (62) for the fastening elements (60), a transporting slide (63) for displacing the fastening elements (60) in the guide channel (62), and a transporting spring (64) for biasing the transporting slide (63) in a transporting direction for feeding a fastening element (60*a*) into the receiving space (17);

a safety device (25) including a press-on member (14) secured on the muzzle part (15); and a device (40) actuatable by the press-on member (14) for allowing the positioning of the transporting slide (63) and for displacing the transporting slide (63) via the fastening elements against a biasing force of the transporting spring (64).

2. A drive-in tool according to claim 1, wherein the press-on member (14) is formed as a press-on feeler (41) displaceable relative to the muzzle part (15) along an axis (A) defined by the drive-in channel (16) between an initial position (36) and a press-on position (37).

3. A drive-in tool according to claim 1, wherein the positioning device (40) comprises a counter-slide (43) mechanically connected with the press-on member (14) and displaceable, dependent on operation of the press-on member (14), between a neutral position (39) and a biasing position (38) for displacing the transporting slide (63) via the fastening elements, respectively, between a position in which the transporting slide (63) is able to advance a fastening element (60*a*) in the receiving space (17) of the drive-in channel (16), and a position in which the transporting slide (63) is movable against a biasing force of the transporting spring (64).

4. A drive-in tool according to claim 3, wherein means for connecting the counter-slide (43) with the press-on member (14) comprises a link drive (45) provided therebetween.

5. A drive-in tool according to claim 1, wherein the press-on member (14) includes an electrical press-on switch (29).

6. A drive-in tool according to claim 1, wherein the positioning device (40) comprises tensioning means for displacing the transporting slide (63) against the biasing force of the transporting spring (64) in a biasing position of the positioning device (40).

7. A drive-in tool according to claim 6, wherein the tensioning means comprises at least one tensioning element (48) and drive means (49) for the tensioning element (48).

8. A hand-held drive-in tool for driving fastening elements (60) in a workpiece (U), comprising:

a guide (12);

a drive-in ram (13) for driving the fastening elements (60) in the workpiece (U);

a muzzle part (15) having a drive-in channel (16) defining a receiving space (17) for a fastening element (60);

a magazine (61) projecting sidewise from the muzzle part (15) and having:

a guide channel (62) for the fastening elements (60), a transporting slide (63) for displacing the fastening elements (60) in the guide channel (62), and a transporting spring (64) for biasing the transporting slide (63) in a transporting direction for feeding a fastening element (60*a*) into the receiving space (17);

a safety device (25) including a press-on member (14) secured on the muzzle part (15); and a device (40) actuatable by the press-on member (14) for allowing the positioning of the transporting slide (63) and for displacing the transporting slide (63) via the fastening elements against a biasing force of the transporting spring (64);

wherein the positioning device (40) comprises a counter-slide (43) mechanically connected with the press-on member (14) and displaceable, dependent on operation of the press-on member (14), between a neutral position (39) and a biasing position (38) for displacing the transporting slide (63) via the fastening elements, respectively, between a position in which the transporting slide (63) is able to advance a fastening element (60*a*) in the receiving space (17) of the drive-in channel (16), and a position in which the transporting slide (63) is movable against a biasing force of the transporting spring (64); and wherein the counter-slide (43) is fork-shaped and has at least two entraining elements (44) defining a free-space and keeping the drive-in channel (12) free in both the neutral position (39) and the biasing position (38) of the counter-slide (43), the at least two entraining elements (44) engaging a carrier strip (65) carrying the fastening elements (60).

9. A hand-held drive-in tool for driving fastening elements (60) in a workpiece (U), comprising:

a guide (12);

a drive-in ram (13) for driving the fastening elements (60) in the workpiece (U);

a muzzle part (15) having a drive-in channel (16) defining a receiving space (17) for a fastening element (60);

a magazine (61) projecting sidewise from the muzzle part (15) and having:

a guide channel (62) for the fastening elements (60), a transporting slide (63) for displacing the fastening elements (60) in the guide channel (62), and a transporting spring (64) for biasing the transporting slide (63) in a transporting direction for feeding a fastening element (60*a*) into the receiving space (17);

a safety device (25) including a press-on member (14) secured on the muzzle part (15); and a device (40) actuatable by the press-on member (14) for allowing the positioning of the transporting slide (63) and for displacing the transporting slide (63) via the fastening elements against a biasing force of the transporting spring (64);

wherein the positioning device (40) comprises tensioning means for displacing the transporting slide (63) against the biasing force of the transporting spring (64) in a biasing position of the positioning device (40);

wherein the tensioning means comprises at least one tensioning element (48) and drive means (49) for the tensioning element (48); and wherein the drive means (49) comprises a take-up spool (95) connected with the at least one tensioning element (48), and an electric motor (94) for rotating the spool.

* * * * *